US005971098A

United States Patent [19]

Suzuki et al.

[11] Patent Number: 5,971,098

[45] Date of Patent: Oct. 26, 1999

[54] MUFFLER FOR INTERNAL COMBUSTION ENGINE

[75] Inventors: Mitsuro Suzuki; Kazunari Ohno; Kunihiko Fujiwara; Tetsuo Kato; Takanori Morishita, all of Okazaki, Japan

[73] Assignee: Futaba Industrial Co., Ltd., Okazaki, Japan

[21] Appl. No.: 09/000,888

[22] Filed: Dec. 30, 1997

Related U.S. Application Data

[62] Division of application No. 08/481,445, Jun. 16, 1995, Pat. No. 5,801,343.

[30] Foreign Application Priority Data

Nov. 9, 1993 [JP] Japan ..... 5-279479

[51] Int. Cl.[6] ..... F01N 1/00

[52] U.S. Cl. ..... 181/254; 181/265; 181/272

[58] Field of Search ..... 181/237, 241, 181/253, 254, 265, 266, 272, 277, 278, 211

[56] References Cited

U.S. PATENT DOCUMENTS

| | | | |
|---|---|---|---|
| 2,083,516 | 6/1937 | Horton | 181/211 |
| 3,620,330 | 11/1971 | Hall | 181/254 |
| 4,484,659 | 11/1984 | Buchwalder | 181/266 |

FOREIGN PATENT DOCUMENTS

| | | |
|---|---|---|
| 55-146819 | 4/1979 | Japan . |
| 57-26221 | 2/1982 | Japan . |
| 63-015539 | 10/1982 | Japan . |
| 58-70412 | 5/1983 | Japan . |
| 60-92716 | 6/1985 | Japan . |
| 1-080615 | 11/1987 | Japan . |
| 1-80615 | 5/1989 | Japan . |
| 1-119817 | 8/1989 | Japan . |
| 2-3009 | 1/1990 | Japan . |
| 3-51124 | 5/1991 | Japan . |
| 5-98930 | 4/1993 | Japan . |

*Primary Examiner*—Khanh Dang
*Attorney, Agent, or Firm*—Davis and Bujold

[57] ABSTRACT

In a muffler for internal combustion engine which is provided with a valve capable of closing and opening an open end of by-pass inner pipe, the opening and closing operation of the valve is performed via the exhaust gas pressure, without being affected by external factors. Also, the structure is simple and easy to be assembled. On a fixed shaft (36) supported in the vicinity of an open end (28*a*) of a by-pass inner pipe (28) is a valve (32) rotatably mounted. The valve (32) is urged against the open end (28*a*) by a coil spring (42), and when fitted in a flange part (38), it closes the open end (28*a*). When the revolving speed of the internal combustion engine is low, the pressure inside the by-pass inner pipe (28) is smaller than the operative force which is an addition of the urging force by the coil spring (42) and the external pressure. The open end (28*a*) is therefore closed. On the other hand, when the revolving speed rises and the pressure has increased to a predetermined pressure, their relation is reversed. Specifically, the valve retracts from the open end (28*a*) thereby placing the by-pass inner pipe (28) in a communicated condition.

15 Claims, 7 Drawing Sheets

FIG.3(a)
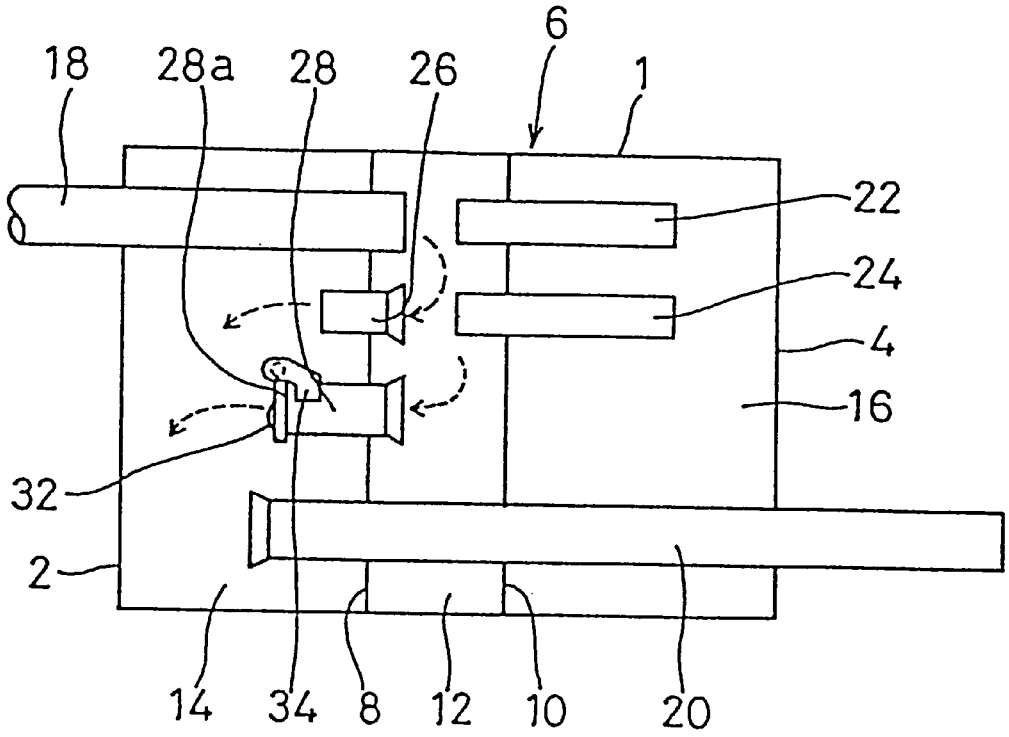
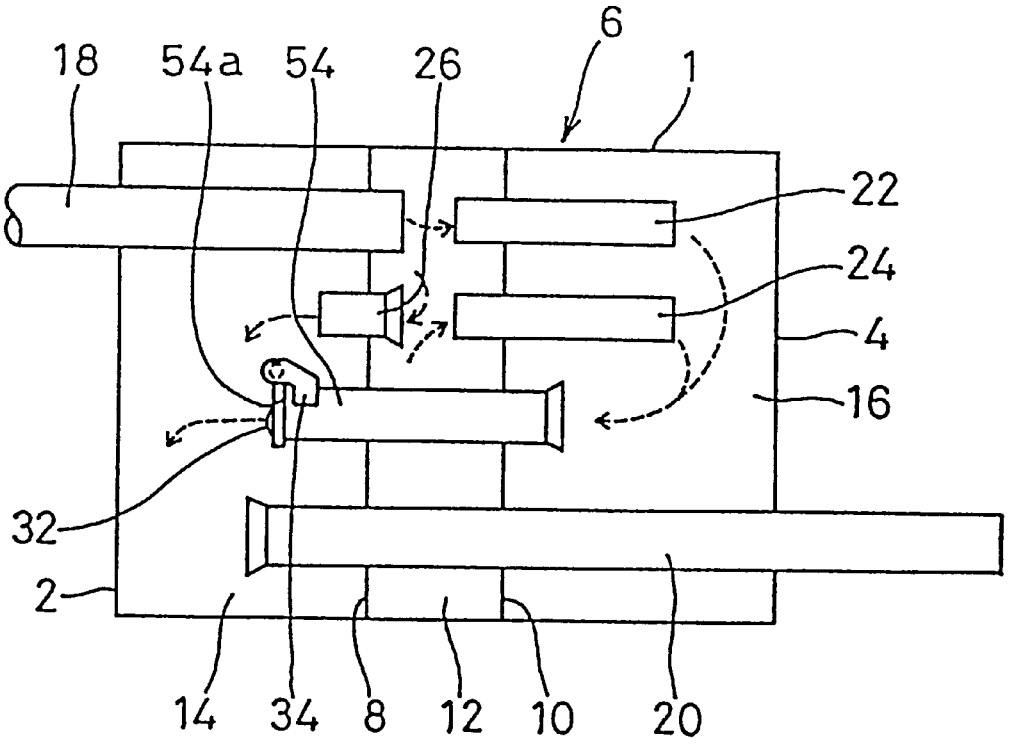
FIG.3(b)

MUFFLER FOR INTERNAL COMBUSTION ENGINE

This is a divisional of application Ser. No. 08/481,445 filed on Jun. 16, 1995, now U.S. Pat. No. 5,801,343.

TECHNICAL FIELD

This invention relates to a muffler for internal combustion engine. Specifically, this invention relates to such a muffler having a valve with which an open end of by-pass inner pipe can be closed and opened.

BACKGROUND ART

Known mufflers for internal combustion engines have a valve capable of closing and opening an open end of by-pass inner pipe. When the revolving speed of internal combustion engine is high, the open end of the muffler is opened to reduce exhaust resistance, thereby mitigating back pressure. When the revolving speed is low, the open end is closed to increase the muffling effect.

For instance, a Japanese Unexamined Patent Publication No. 5-98930 proposes an arrangement shown in FIG. 6. In that figure, a valve 103 is fixed at the foot of an open end 101*a* of a by-pass inner pipe 101, and is pivotable with respect to a connection plate 104 serving as a fulcrum. The connection plate 104 is made of flexible metal and has a bimetal 105 attached to its outer surface. In assembly, the valve 103 is positioned at the position indicated by the bold line in FIG. 6.

In this arrangement, when the revolving speed of internal combustion engine is high and the exhaust gas becomes hot, the bimetal 105 is heated and bends as a result of the temperature change. Responsively, the valve 103 opens wide and reaches the position indicated by a dot-dash line in FIG. 6, thereby reducing back pressure. On the other hand, when the revolving speed is low and the exhaust gas is of a lower temperature, the valve 103 reaches the position indicated by a broken line in FIG. 6 and closes the open end 101*a,* thereby providing an increased muffling effect. In such arrangement, even if the temperature of the exhaust gas is relatively low, it is still higher compared to the temperature during the assembly of the valve 103. In order to allow for the bending degree of the bimetal 105 which varies according to temperatures, in the arrangement the open end 101*a* projects forward in a predetermined angle.

Meanwhile, it has also been proposed to utilize means other than temperature in controlling the valve.

For instance, a Japanese Unexamined Utility Model Publication No. 2-3009 controls closing and opening of an open end by means of pressure. Specifically, as shown in FIG. 7(*a*), the prior art suggests a muffler having a housing 116 the inner space of which is divided into three chambers. Into separate expansion chambers 112, 114 are inlet pipe 118 and an outlet pipe 120 inserted. The expansion chambers 112, 114 communicate with one another via two parallel inner pipes 126, 128, one 128 (hereinafter referred to as "by-pass inner pipe") of which has an open end 128*a,* at the lower reaches of the exhaust gas stream, which is provided with a valve 132 for a valve mechanism 130.

In such a muffler, the by-pass inner pipe 128 opens, at the upper reaches of exhaust gas stream, into the first expansion chamber 112. When the pressure inside the first expansion chamber 112 is equal to or below a predetermined value, the urging force from a spring 142, shown in FIG. 7(*b*), of the valve mechanism 130 and the pressure inside the second expansion chamber 114 are together acting on the valve 132 to keep the open end 128*a* closed. On the other hand, when the pressure becomes equal to or above a predetermined value, the valve 132 resists the urging force from the spring 142 of the valve mechanism 130 and other pressures, and retracts away from the open end 128*a,* thereby opening the open end 128*a.* Thus, when the revolving speed is low and so is the pressure, the open end 128*a* is closed by the urging force from the spring 142 and other pressures, and an enhanced muffling effect is provided. On the other hand, when the revolving speed is high and the pressure is high enough to open the open end 128*a,* further rise of the back pressure is prevented. Since the closing and opening of the open end 128*a* by the valve 132 occurs in a quick response to the shift of the exhaust gas pressure, it is enabled to control the valve 132 appropriately in accordance with the revolving speed of internal combustion engine.

However, as previously described, the former type of muffler utilizes the property of the bimetal 105 which bends in a varied degree according to temperatures. Since this method has a problematic time lag intrinsic to the bimetal 105 in responding to the shift of the exhaust gas temperature and reaching a critical temperature, it is quite difficult to have the revolving speed of internal combustion engine appropriately reflected upon the control of the valve 103 to be closed or opened, and an inappropriate control is resulted.

On the other hand, the latter type of muffler requires a number of components other than the valve 132 and the spring 142 urging the valve 132 against the open end 128*a*. Such components include, as shown in FIG. 7(*b*), a shaft 140 to support the valve 132, and a piston 144 and cylinder 146 which are connected to the shaft 140. The numerous components add to cost and because, as shown in FIG. 7(*a*), they need to be assembled to the exterior of the housing 116, the assembly is laborious and needs protective measures against external factors, such as smash of stones and salt injury.

DISCLOSURE OF INVENTION

In order to solve the above problem, an object of the present invention is to provide a muffler for internal combustion engine, which has a valve capable of appropriately closing and opening an open end of a by-pass inner pipe. The closing and opening operation by the valve is performed by means of exhaust gas pressure, and the muffler is not affected by external factors and has so simple structure that its assembly can be readily performed.

In order to attain the above object, the muffler for internal combustion engine according to the invention includes a housing divided into a plurality of chambers, wherein a first chamber of the plurality of chambers has an exhaust gas inlet pipe inserted therein; a second chamber of the plurality of the chambers has an exhaust gas outlet pipe inserted therein; and the first and second chambers are communicated with one another via at least one inner pipe which is forming an exhaust gas path extending through a chamber and another chamber among the plurality of chambers to communicate the chambers with one another.

The muffler also includes:

- a by-pass inner pipe communicating a chamber and another chamber with one another;
- a valve capable of closing and opening an open end of the by-pass inner pipe and pivotable around a fulcrum provided in the vicinity of an open end of the by-pass inner pipe at the lower reaches of the exhaust gas stream; and
- an urging member provided in the vicinity of an open end of the by-pass inner pipe at the lower reaches of the exhaust gas stream.

When the pressure inside the chamber where the open end of the by-pass inner pipe at the upper reaches of exhaust gas stream is located becomes equal to or above a predetermined value, the valve is caused to retract away from and thereby open the open end.

The invention is the muffler for internal combustion engine, wherein the by-pass inner pipe has a tapered surface such that the diameter of the open end of the by-pass inner pipe at the lower reaches of exhaust gas stream becomes greater toward the valve, and the valve has an abut surface formed in such a shape which substantially corresponds to the tapered surface.

The invention is the muffler for internal combustion engine but the fulcrum having the valve pivotably mounted thereon is formed in this claim as a shaft supported by a shaft supporting part which is provided adjacent to the open end of the by-pass inner pipe at the lower reaches of exhaust gas stream. Moreover, a buffer material is provided to intermediate the valve and the shaft supporting part.

The invention is the muffler with a shock absorber material between the valve and the open end of the by-pass inner pipe at the lower reaches of exhaust gas stream.

In the muffler having the above described structure, as long as the pressure inside the chamber where the open end of the by-pass inner pipe at the upper reaches of exhaust gas stream is located is equal to or below a predetermined value, the valve is held staying on the open end and thereby closing it owing to the urging force applied by the urging member and the pressure inside the chamber into which the open end at the lower reaches opens. On the other hand, when the pressure is equal to or above a predetermined value, the high pressure causes the valve to resists the urging force applied by the urging member and other pressures. As a result, the valve retracts away from and thereby opens the open end. Therefore, when, for instance, the revolving speed of internal combustion engine is low and so is the pressure of the exhaust gas, the open end of the by-pass inner pipe is closed, thereby providing an increased muffling effect. On the other hand, when the revolving speed is high and so is the exhaust gas pressure, the open end is opened so that back pressure is mitigated.

In the muffler for internal combustion engine, the valve is pivotable around a fulcrum provided adjacent to the open end of the by-pass inner pipe. Since the above described operation is performed between such valve and the urging member urging the valve, the number of required components is less, the assembly can be efficiently conducted and the structure is costwise. Moreover, since the structure is installed inside the housing, it is not affected by external factors. Further, since in the muffler of the present invention the valve operates instantly when the exhaust gas pressure rises or falls, closing and opening of the open end by the valve can be controlled more appropriately than the control of the valve in accordance with temperature change.

In addition to the advantage of the muffler of the muffler has the following advantage. Specifically, when the valve is to close the open end of the by-pass inner pipe at the lower reaches of exhaust gas stream, the valve pivots around the fulcrum toward the open end until the abut surface of the valve collides with and intimately abuts the tapered surface of the open end and thereby the open end is closed. Since the tapered surface of the open end forms a predetermined angle toward the collision direction, the collision impact afflicted upon the tapered surface by the abut surface of the valve is alleviated because, for instance, it is; (1) dispersed in the collision direction and in radially outward direction; (2) dispersed as friction between the abut surface of the valve and the tapered surface of the open end. In this way, generation of unpleasant noises that would be generated by the collision is prevented. Moreover, even if the abut surface of the valve is in a slightly floated position with respect to the tapered surface of the open end, the contact between them is maintained or the interval between them is only minimal. Therefore, no adverse influence is afflicted on muffling effect.

The muffler has the following advantage. Specifically, while the valve is pivotably mounted via the shaft which is supported by the shaft supporting part, a buffer material intermediates the valve and the shaft supporting part. Therefore, even if the valve vibrates due to various causes such as the vibration of the internal combustion engine, the vibration is absorbed and the valve is prevented from colliding against the shaft supporting part.

The muffler has the following advantage. Specifically, when the valve is to close the open end of the by-pass inner pipe at the lower reaches of exhaust gas stream, the valve pivots toward the open end around the fulcrum until the valve collides with the open end. As a result, they contact and fit snugly with one another, thereby closing the open end. The collision does not generate an unpleasant noise since the shock absorber material provided between the valve and the open end absorbs the collision impact between the valve and the open end.

BRIEF EXPLANATION OF DRAWINGS

FIG. 3(*a*) and FIG. 3(*b*) are schematic sectional views of the muffler of each embodiment: FIG. 3(*a*) is a schematic sectional view of the first embodiment: FIG. 3(*b*) is a schematic sectional view of the second embodiment.

FIG. 7(*a*) is a schematic structure view: FIG. 7(*b*) is a schematic sectional view of a valve mechanism.

BEST MODE FOR CARRYING OUT THE INVENTION

Figure 1:
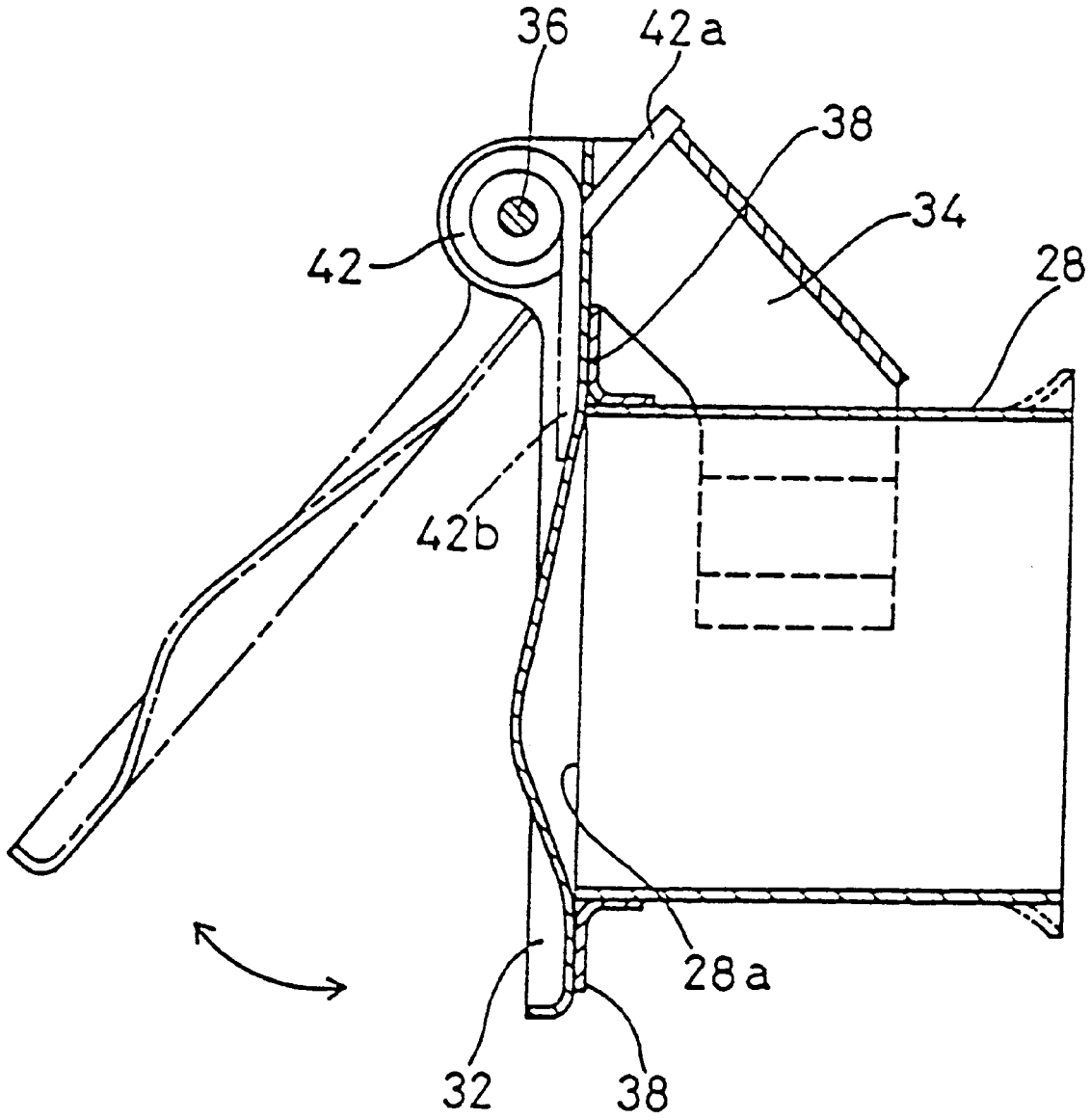
FIG. 1 is a schematic sectional view showing a part of the by-pass inner pipe of the fist embodiment.

Embodiments of the present invention will be described hereinafter with reference to the drawings.

FIG. 3 are schematic structure views of each embodiment and FIG. 3(*a*) is a schematic structure view of the first embodiment.

The muffler of the first embodiment has a housing 6, whose cylindrical outer wall 1 is closed at both ends by a front end wall 2 and a rear end wall 4. The interior of the housing 6 is sectioned by a first shield 8 and a second shield 10, thereby forming; a first expansion chamber 12, or first chamber in the present invention, surrounded by the first shield 8, the second shield 10 and the outer wall 1; a second expansion chamber 14, or second chamber in the present invention, surrounded by the front end wall 2, the first shield 8 and the outer wall 1; and a resonator chamber 16 surrounded by the rear end wall 4, the second shield 10 and the outer wall 1.

On the other hand, a not-shown ventilation tube for an internal combustion engine communicates via, for instance, a catalytic apparatus with an inlet pipe 18 which penetrates through the front end wall 2 and the first shield 8 and opens at its one end in the first expansion chamber 12. Likewise, an outlet pipe 20 penetrates through the first shield 8, second shield 10 and the rear end wall 4 and opens at its one end in the second expansion chamber 14 while the other end is opened in the outside so as to communicate the second expansion chamber 14 with the outside.

Moreover, the second shield 10 receives a first resonance pipe 22 and second resonance pipe 24 which communicate the first expansion chamber 12 and the resonator chamber 16 with one another. Further, the first shield 8 receives an inner pipe 26 and by-pass inner pipe 28 which communicate the first expansion chamber 12 and second expansion chamber 14 with one another in parallel.

Figure 2:
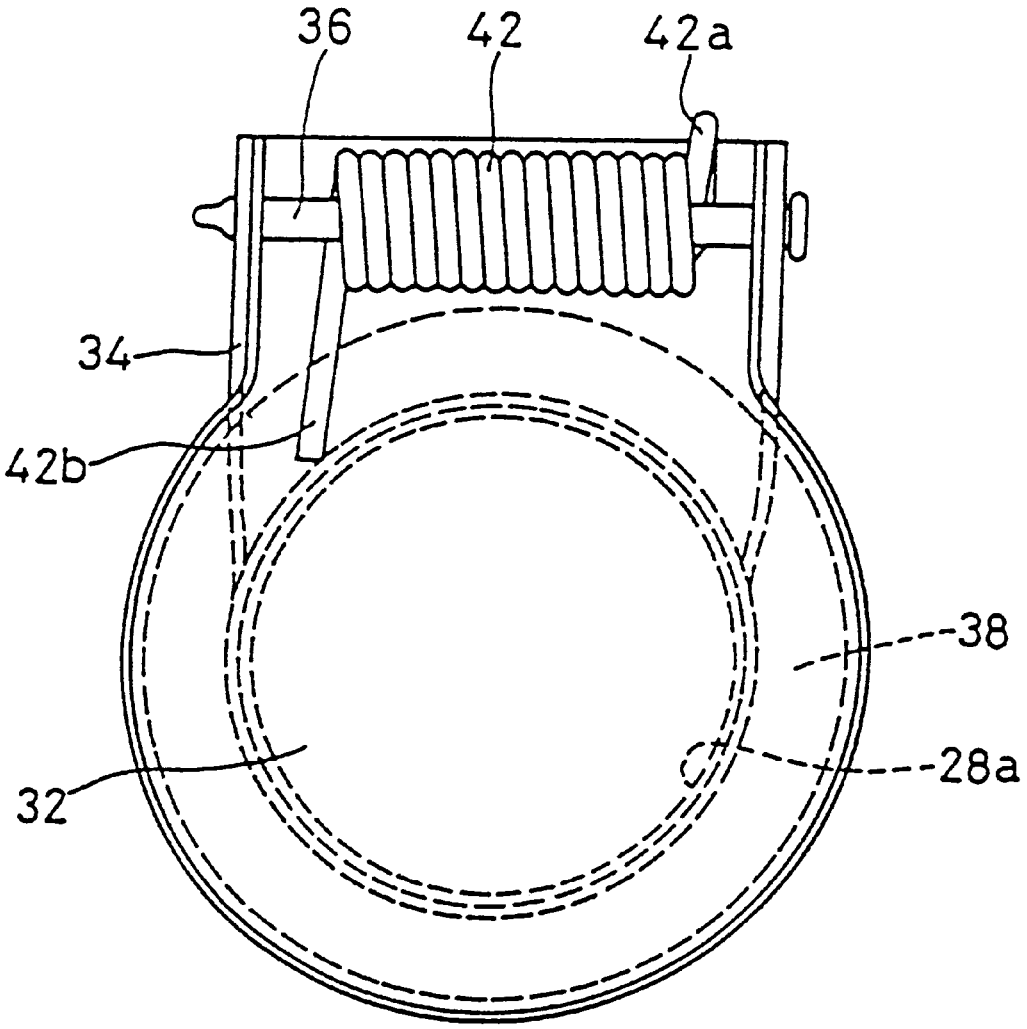
FIG. 2 is a front view of the by-pass inner pipe of the first embodiment.

FIG. 1 is a schematic sectional of the by-pass inner pipe 28 and FIG. 2 is its front view.

A stay (shaft supporting part) 34 is welded adjacent to an open end 28*a* at which the by-pass inner pipe 28 opens at the side of the second expansion chamber 14, and supports a fixed shaft 36 serving as a fulcrum of the present invention. The open end 28*a* is also provided with a flange part 38. A valve 32 is pivotably mounted to the fixed shaft 36 and has a substantial circular shape having a convex portion in the vicinity of its central portion. A coil spring 42 is provided such that the fixed shaft 36 penetrates through the axial center of the coil spring 42, with its one arm portion 42*a* fixed to the stay 34 and the other arm portion 42*b* fixed to the valve 32. The valve 32 is accordingly pivotable in the direction indicated by an arrow in FIG. 1, while urged by the coil spring 42 toward the open end 28*a* to fit with the flange part 38 and close the open end 28*a*. (See a bold line in FIG. 1).

Subsequently, the operation of the muffler of the present embodiment will be now explained.

As shown in FIG. 3(*a*), exhaust gas from internal combustion engine is introduced via the inlet pipe 18 into the first expansion chamber 12. The exhaust gas fed into the first expansion chamber 12 is first expanded in the first expansion chamber 12, then passed via the inner pipe 26 into the second expansion chamber 14 and again expanded there. Meanwhile, the exhaust gas led into the resonator chamber 16 via the resonance pipe 22, 24 causes resonance in a predetermined frequency, which interferes with the pressure wave in the first expansion chamber 12 such that exhaust noise is muffled. Thus, the pressure pulsation of exhaust gas is leveled and the muffled exhaust gas within the second expansion chamber 14 is discharged to the outside via the outlet pipe 20. As shown in a broken line of FIG. 3(*a*), the path from the first expansion chamber 12 via the inner pipe 26 to the second expansion chamber corresponds to the exhaust gas path of the present invention.

When the pressure inside the first expansion chamber 12 is low because, for example, the revolving speed of internal combustion engine is low, the difference between the pressure inside the first expansion chamber 12 and that inside the second expansion chamber 14 is small. In this case, the operative force of the pressure inside the first expansion chamber 12 that passes via the by-pass inner pipe 28 and is acting on the valve 32 in leftward direction in FIG. 1 is smaller than the addition of the urging force applied by the coil spring 42 and the pressure within the second expansion chamber 14 that is acting on the valve 32 in rightward direction in FIG. 1. As a result, the open end 28 remains closed by the valve 32 and an increased muffling effect is provided.

On the other hand, when the operation condition of internal combustion engine has changed, for example when the revolving speed of internal combustion engine has increased and the volume of exhaust gas is increased until the pressure reaches a predetermined value, the operative force of the pressure inside the first expansion chamber 12 that is acting via the by-pass inner pipe 28 on the valve 32 in leftward direction in FIG. 1 becomes greater than the addition of the mentioned urging force and the operative force in rightward direction in FIG. 2. Resultantly, the valve 32 resists against the pressure and retracts away from the open end 28*a,* thereby placing the by-pass inner pipe 28 in a communicated condition (indicated by a dot and dash line in FIG. 1). Specifically, between the first expansion chamber 12 and the second expansion chamber 14 there is provided a by-pass path indicated by arrows of dotted line in FIG. 3(*a*), in addition to the exhaust gas path indicated by arrows of broken line in that figure.

In this way, when the pressure inside the first expansion chamber 12 becomes equal to or above predetermined value, the by-pass inner pipe 28 is placed in a communicated condition to form an additional by-pass path. Therefore, even if the volume of exhaust gas introduced into the first expansion chamber 12 increases, the exhaust gas is instantly expelled into the second expansion chamber 14. Accordingly, the pressure inside the first expansion chamber 12 does not become overly high: the increase of the exhaust gas pressure from internal combustion engine does not result in an increase of the back pressure. Moreover, even if the flow of exhaust gas increases, flow noise is maintained in a low level since the pressure rise within the muffler is restrained.

Effects of the described first embodiment are as follows.

① Since the above operation is performed between the valve 32 pivotably mounted to the fixed shaft 36 in the vicinity of the open end 28*a* of the by-pass inner pipe 28 and the coil spring 42 urging the valve 32, the number of required components is minimal and an efficient assembly and a reduced cost is attained. In addition, since these components are installed inside the housing 6, they are free from smash of stones, salt injury and other external factors.

② The valve operates in a quick response to the rise and fall of exhaust gas pressure. Therefore, compared to the method of opening a valve in accordance with the rise and fall of temperature, closing and opening of the open end 28*a* by the valve 32 can be effected in an appropriate manner. Since the valve 32 has externally a convex portion at its center, the change of exhaust gas pressure can be more efficiently transmitted to the valve 32, resulting in a more appropriate control of the valve 32.

Subsequently, the muffler according to the second embodiment will be now explained with reference to FIG. 3(*b*). FIG. 3(*b*) is a schematic sectional view of the second embodiment.

Elements which are similar to those of the first embodiment are indicated by the same numerals, and their detailed explanation is omitted. The instant muffler has a communication pipe 54 in place of the by-pass inner pipe 28 of the first embodiment. The communication pipe 54 serves as a by-pass inner pipe and penetrates through the first shield 8 and the second shield 10 to communicate the second expansion chamber 14 and the resonator chamber 16 with one another. An open end 54*a* of the communication pipe 54 opening at the second expansion chamber 14 is to receive the described valve 32. When the exhaust gas is less and the pressure is low, the muffler operates in a similar manner to the first embodiment. When the pressure is high, the valve 32 moves in the leftward direction in FIG. 3(*b*) to place the communication pipe 54 in a communicated condition. Specifically, between the first expansion chamber 12 and the second expansion chamber 14 there is provided a by-pass path indicated by arrows of dotted line in FIG. 3(*b*), in addition to the exhaust gas path indicated by arrows of broken line in that figure.

When the pressure inside the resonator chamber 16 becomes equal to or above a predetermined value, the communication pipe 54 is placed in a communicated condition to form the by-pass path. Therefore, even if the volume of exhaust gas introduced into the first expansion chamber 12 has increased, it is quickly expelled into the second expansion chamber 14 via the first and second resonator chambers 22, 24 and the communication pipe 54. Accordingly, the pressure inside the first expansion chamber 12 does not become overly high, and a rise of the pressure of exhaust gas coming from internal combustion engine does not result in an increase in the back pressure. Moreover, even if the amount of exhaust flow has increased, rise of the pressure within the muffler is restrained, resulting in a reduction of flow noise.

Effects of the second embodiment are similar to those of the first embodiment, and therefore their detailed explanation is omitted.

Figure 4:
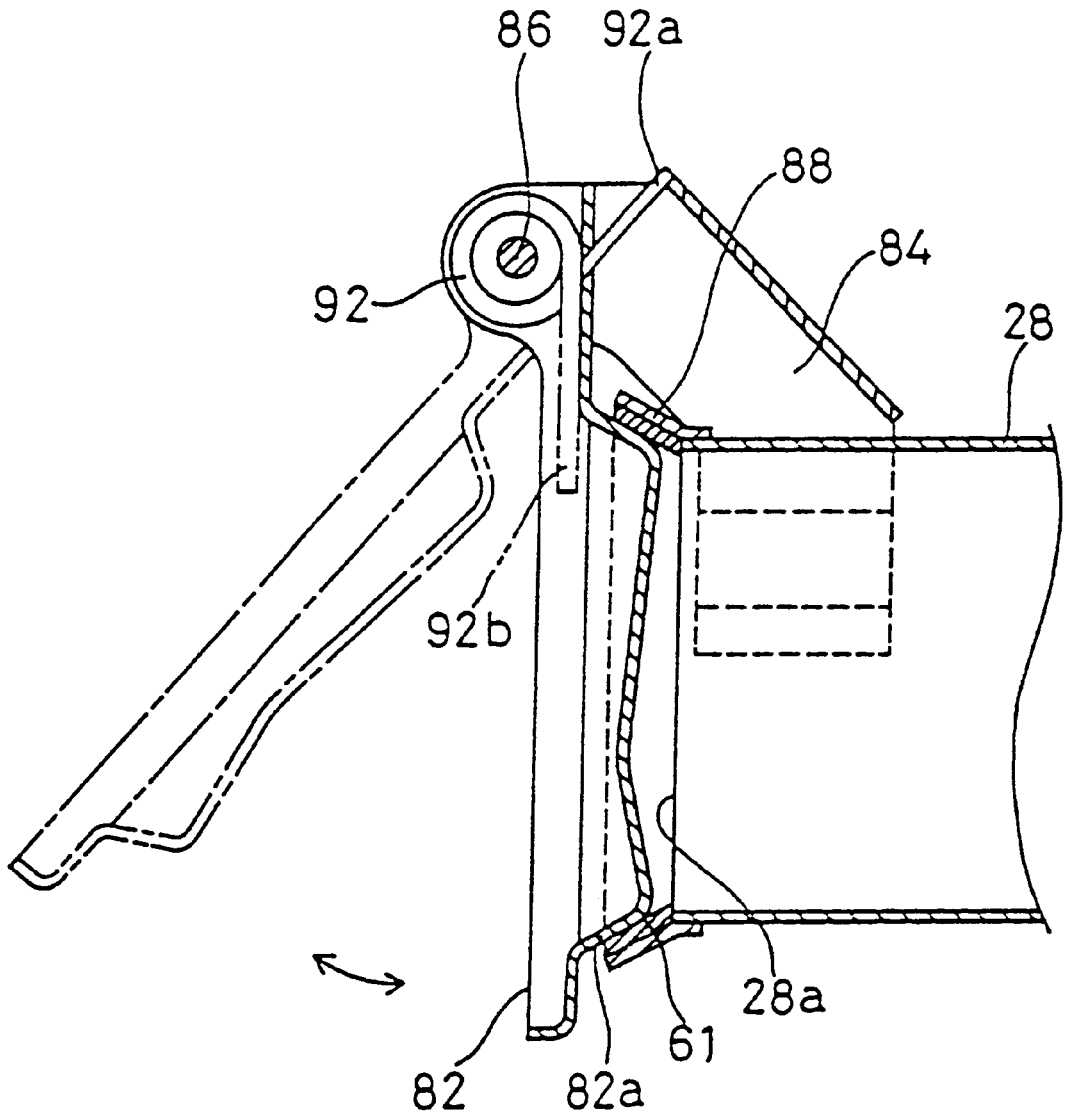
FIG. 4 is a schematic sectional view showing a part of the by-pass inner pipe of the third embodiment.
Figure 5:
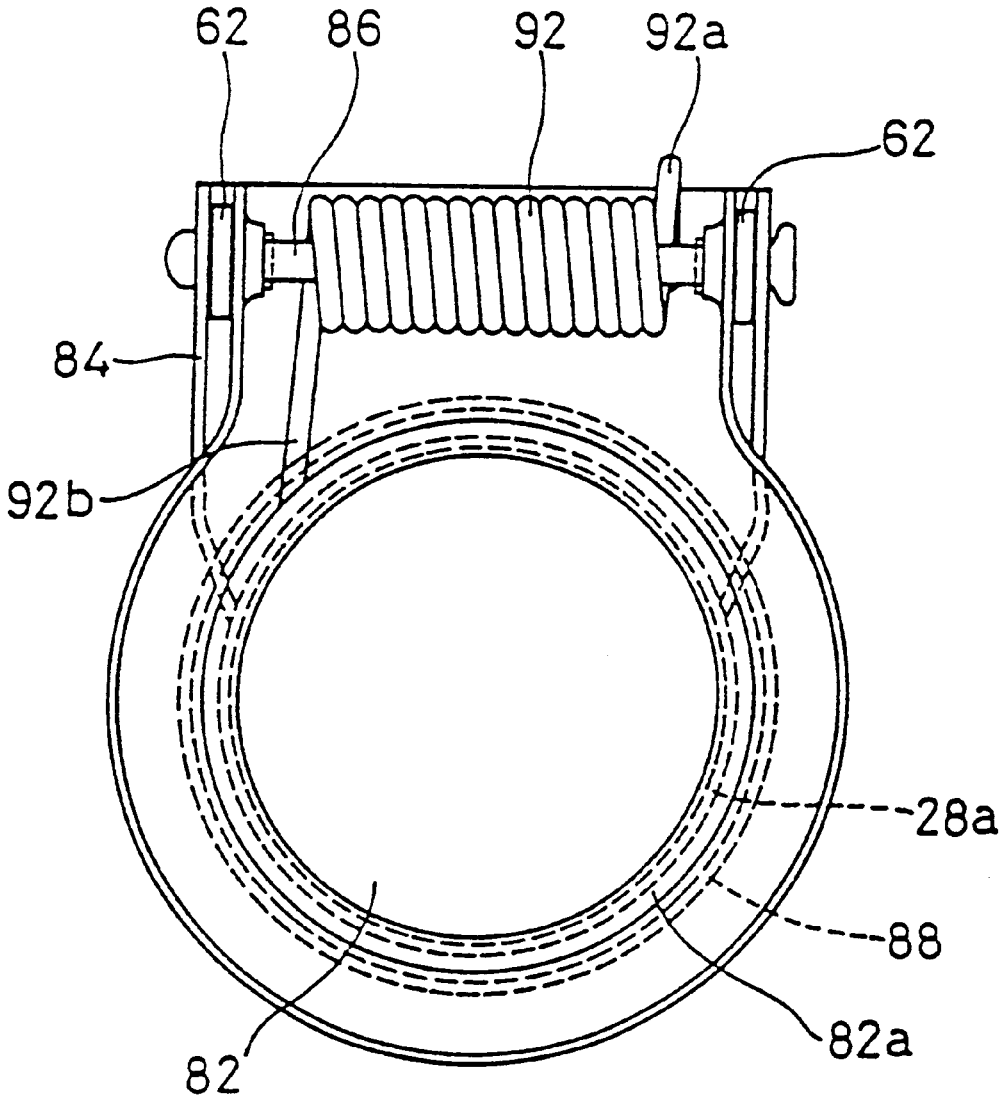
FIG. 5 is a front view of the by-pass inner pipe of the third embodiment.
Figure 6:
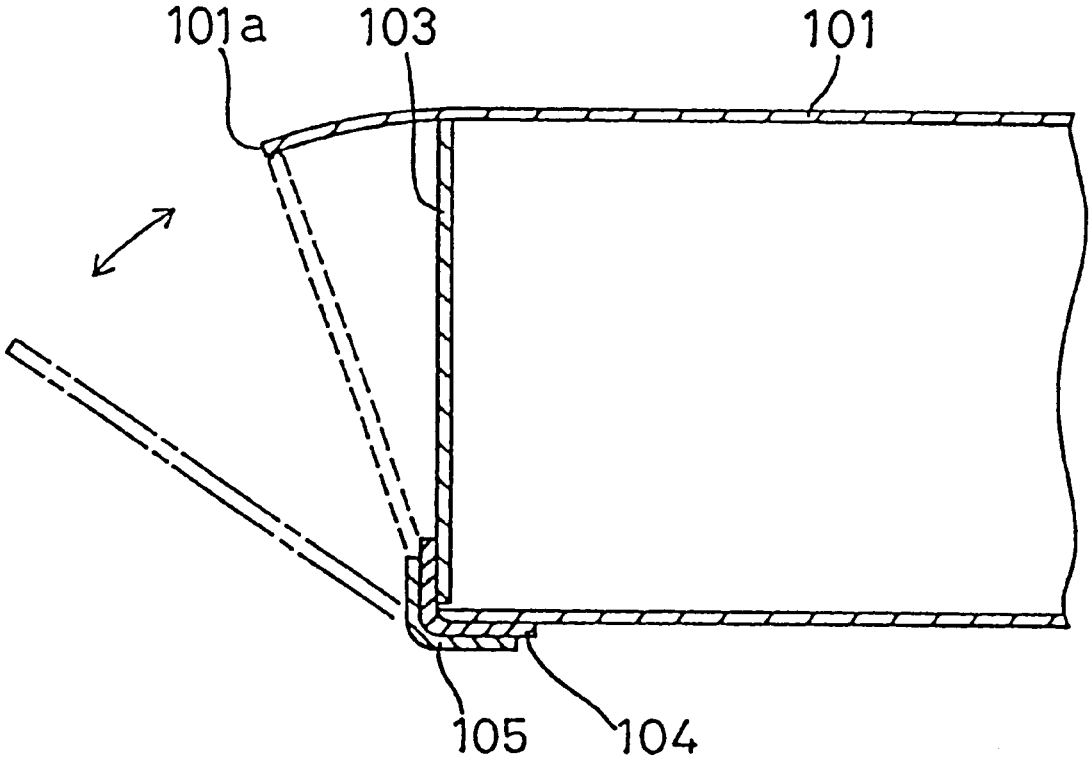
FIG.6 PRIOR ART
FIG. 6 is a schematic sectional view showing a conventional muffler.
Figure 7A:
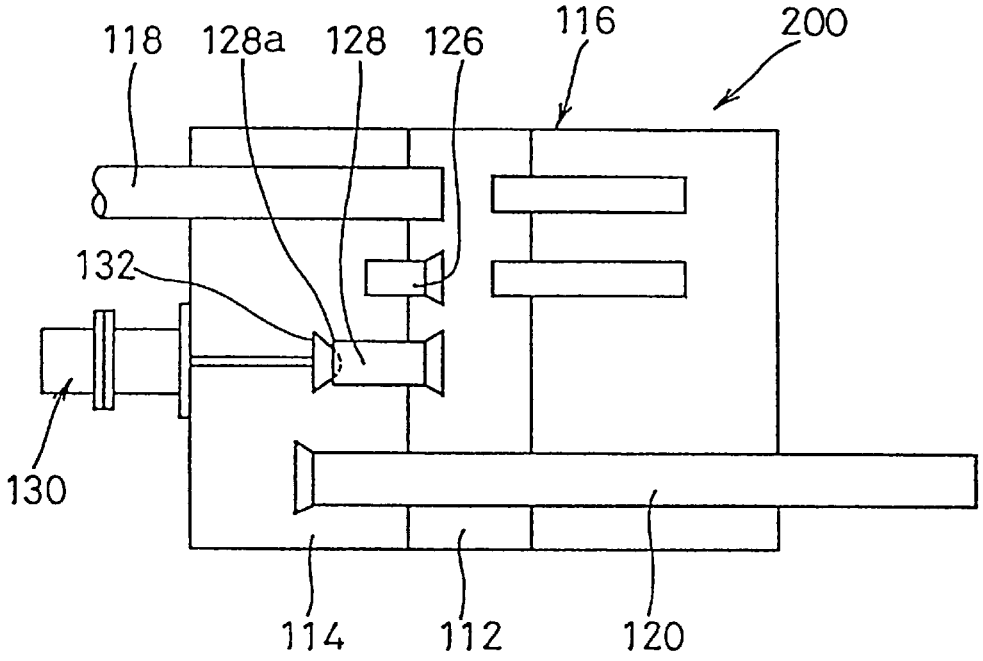
FIG.7(a) PRIOR ART
FIG. 7(*a*) and FIG. 7(*b*) are explanatory views showing another conventional muffler.
Figure 7B:
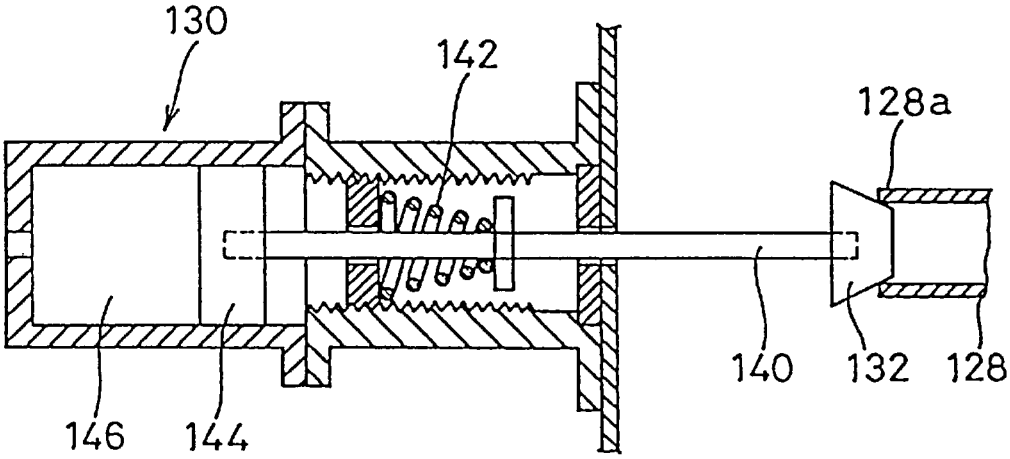
FIG.7(b) PRIOR ART

Subsequently, the muffler of the third embodiment will be now explained. The third embodiment is similar to the first embodiment, except that the by-pass inner pipe 28 has a different construction at the side of the open end 28*a*. Therefore, provided hereinafter is the description of only the open end 28*a* of the by-pass inner pipe 28. FIG. 4 is a schematic sectional partial view of the by-pass inner pipe 28 and FIG. 5 is its front view.

Adjacent to the open end 28*a* of the by-pass inner pipe 28 is a stay (shaft supporting part) 84 welded, to support a fixed shaft 86 which serves as a fulcrum of the present invention. The open end 28*a* has a tapered part 88 which extends radially outward. Further, the inner peripheral surface (tapered surface) of the tapered part 88 is provided with a first wire mesh 61 for serving as a shock absorber material.

A valve 82 has in its central portion a ridge portion 82*a* whose shape is substantially a circular truncated cone. The outer peripheral surface of the ridge portion 82*a* is formed into such a shape as to fit snugly with the wire mesh 61 provided at the tapered part 88. The valve 82 is pivotably mounted to the fixed shaft 86. A second wire mesh 62, as a buffer material, intermediates the stay 84 supporting the fixed shaft 86 and the valve 82. A coil spring 92 is provided such that the fixed shaft 86 penetrates through the axial center of the coil spring 92, with one arm portion 92*a* thereof fixed to the stay 84 while the other arm portion 92*b* fixed to the valve 82. The valve 82 is accordingly pivotable around the fixed shaft 86 in the direction indicated by an arrow in FIG. 4, while urged by the coil spring 92 toward the open end 28*a* to make the ridge portion 82*a* of the valve 82 fit snugly with the pressing first wire mesh 61 provided at the tapered part 88, to close the open end 28*a* (See a bold line in FIG. 4).

Subsequently, according to the third embodiment the closing and opening action by the valve 82 of the by-pass inner pipe 28 will be explained. Since the action at issue is basically similar to that of the first embodiment, provided hereinafter is the description only as to the difference from the first embodiment.

When the valve 82 is to close the open end 28*a* of the by-pass inner pipe 28, the valve 82 swivels from an open position (indicated by two dash lines of FIG. 4) toward the open end 28*a* around the fixed shaft 86, until the ridge portion 82*a* of the valve 82 is received in the tapered part 88 of the open end 28*a* and thereby the open end 28*a* is closed. The impact of the ridge portion 82*a* of the valve 82 against the tapered part 88 of the open end 28*a* is lower than that of the first embodiment because: (1) the impact is dispersed in the collision direction (i.e. the axial direction of the by-pass inner pipe 28) and in the radially outward direction, (2) the impact is dispersed as a friction between the ridge portion 82*a* and the first wire mesh 61, (3) the impact is absorbed by the first wire mesh 61, and other reasons. Hence, noises which would be caused by the collision between the valve 82 and the open end 28*a* when the open end 28*a* of the by-pass inner pipe 28 is closed by the valve 82 is smaller compared to that of the first embodiment.

Moreover, even if the ridge portion 82*a* of the valve 82 is in a floated position with respect to the inner peripheral surface (tapered surface) of the tapered part 88 because of, for instance the vibration of internal combustion engine, the ridge portion 82*a* and the tapered part 88 remain in a favorable contact with one another, or, even if there is an interval between the ridge portion 82*a* and the inner peripheral surface (abut surface), that interval is only minimal. Accordingly, the muffling effect is not affected even when the pressure inside the first expansion chamber 12 (See FIG. 3(*a*)), e.g. the revolving speed of internal combustion engine is still low.

Especially, due to the variation of the exhaust gas pulsation pressure according to the type of automobiles, when the same muffler was used in different types of automobiles, the pulsation pressure would cause the valve to vibrate and incessantly hit the open end to make noises, and the sealed condition was deteriorated to lower the muffling effect. By utilizing the by-pass inner pipe 28 of the third embodiment, the problems can be solved.

Further, while the valve 82 is pivotably mounted via the fixed shaft 86 which is supported by the stay 84, the second wire mesh 62 intermediates the valve 82 and the stay 84. Therefore, even if the valve 82 vibrates due to the vibration of internal combustion engine or the like, the second wire mesh 62 absorbs the vibration, thereby preventing the valve 82 from colliding against the stay 84. Thus, noises due to the collision between the valve 82 and the stay 84 are not caused.

Additionally, the apparatus according to the third embodiment is also endowed with the advantage of the first embodiment, by definition.

The present invention is not limited to the above described embodiments. Various modifications are possible within the scope of the spirit of the invention.

For example, it would be possible to provide a plurality of by-pass inner pipe 28 or communication pipe 54 having the above-described valve 32, coil spring 42 and other components and, by adjusting the urging force of respective coil spring 42, arrange them to make their respective valve open at different pressures. As a result, each of the by-pass paths would attain communication at different pressures.

The urging member according to the present invention may be other than the above-described coil spring 42, so long as it operates in a similar manner. For example, the urging member may be a plate spring or cushion. Moreover, taking the exposure to high temperature into consideration, the material of the urging member would preferably be heat resistant alloy, for example stainless steel such as SUS631, Inconel (product name) and ceramics.

Further, a gasket or other sealing member may be provided on the flange part 38 which is provided at the open end

28*a* of the by-pass inner pipe 28, 54 of the first or second embodiment to enhance the sealing performance of the valve 32 against the open end 28*a*.

Still further, a wire mesh may be provided, as a buffer material, at the open end 28*a* of the by-pass inner pipe 28, 54 of the first or second embodiment. In this case, even if the valve in opened state pivots against the open end and collides against the open end, the collision impact is absorbed by the wire mesh. Noises due to the collision of the valve against the open end is thus reduced.

Furthermore, in the third embodiment, in stead of providing the first wire mesh 61 at the tapered part 88 of the open end 28*a,* the first wire mesh 61 may be provided on the outer peripheral surface of the ridge portion 82*a* of the valve 82.

INDUSTRIAL APPLICABILITY

As described above, the muffler having the valve which can close or open the open end of the by-pass inner pipe, an appropriate opening and closing of the valve is attained by means of exhaust gas pressure. Additionally, the muffler is immune to external factors, and has such a simple structure that the assembly can be readily performed.

In addition to the advantage of the invention, since the open end is provided with a tapered surface and the abut surface of the valve substantially corresponds to the tapered surface, noises due to the collision between the valve and the open end is reduced. Even if the abut surface of the valve slightly in a floated position from the tapered surface of the open end, the contact between them is maintained, or the interval, if any, between them is only minimal, without affecting the muffling effect.

For instance, since the pulsation pressure of exhaust gas varies with respect to the type of automobile, in the conventional arts the valve is vibrated by the pulsation pressure when the same muffler is utilized in different types of automobile. As a result, the valve makes noises by repeatedly hitting against the open end of the by-pass inner pipe. In other cases, despite the muffling effect to be maintained, the valve retracts away from the open end of the by-pass inner pipe, thereby deteriorating the sealed condition. The apparatus of the invention according to claim 2 solves such problem.

Further, according to the invention specified in claim 3, in addition to the advantages of claims 1 and 2, even if the valve vibrates due to the vibration of internal combustion engine and other factors, noises that would result from the collision between the valve and the shaft supporting part is prevented because the buffer material interposing between the valve and the shaft supporting part absorbs the vibration.

Still further, according to the invention, the shock absorber material provided between the valve and the open end of the by-pass inner pipe absorbs the collision impact between the valve and the open end, thereby reducing noises due to the collision therebetween.

What is claimed is:

1. A muffler for an internal combustion engine, comprising:

a) a housing having a plurality of separate chambers, each of said chambers being separated from said other chambers by a partitioning wall;

b) an inlet pipe communicating with a first of the chambers for introducing exhaust gas to the first chamber;

c) an outlet pipe communicating with a second of the chambers for exhausting gas from the muffler;

d) a port in the partitioning wall separating the first and second chambers to provide an exhaust gas path extending from the first to the second chamber to permit exhaust gas to flow from the inlet pipe to the outlet pipe;

e) at least one second port in the partitioning wall separating the first and a third chamber to permit exhaust gas to flow between the first and third chambers;

f) a by-pass pipe providing an exhaust gas path extending from the third to the second chamber to permit exhaust gas to flow from the third chamber to the outlet pipe;

g) a flap valve, provided at an open downstream end of the by-pass pipe and supported on a shaft displaced laterally of and proximate the open end, the flap valve being movable between a position at which the flap valve closes the downstream open end and a position at which the flap valve allows exhaust gas to flow through the by-pass pipe; and h) a resilient member positioned and supported proximate the flap valve to resiliently bias the valve to the position at which the open end is closed while permitting exhaust gas in the by-pass pipe to move the valve against the resilient bias to allow exhaust gas to flow through the by-pass pipe when the exhaust gas in the by-pass pipe reaches a desired pressure;

wherein a buffer material is interposed between the flap valve and a stay supporting the shaft.

2. A muffler according to claim 1, wherein the flap valve has a convex portion proximate its central portion.

3. A muffler according to claim 1, wherein the flap valve and the open end for receiving the flap valve are frustoconical.

4. A muffler according to claim 1, wherein the flap valve engages the open downstream end of the by-pass pipe and a shock absorbing material is interposed between the flap valve and the open downstream end of the by-pass pipe.

5. A muffler for an internal combustion engine, comprising:

a) a housing having a plurality of separate chambers, each of said chambers being separated from said other chambers by a partitioning wall;

b) an inlet pipe communicating with a first of the chambers for introducing exhaust gas to the first chamber;

c) an outlet pipe communicating with a second of chambers for exhausting gas from the muffler;

d) a port in the partitioning wall separating the first and second chambers to provide an exhaust gas path extending from the first to the second chamber to permit exhaust gas to flow from the inlet pipe to the outlet pipe;

e) at least one second port in the partitioning wall separating the first and a third chamber to permit exhaust gas to flow between the first and third chambers;

f) a by-pass pipe providing an exhaust gas path extending from the third to the second chamber to permit exhaust gas to flow from the third chamber to the outlet pipe;

g) a flap valve, provided at the open downstream end of the by-pass pipe and supported on a shaft displaced laterally of and proximate the open downstream end, the flap valve being movable between a position at which the flap valve closes the by-pass pipe and a position at which the flap valve allows exhaust gas to flow through the by-pass pipe; and h) a resilient member positioned and supported proximate the flap valve to resiliently bias the flap valve to the position at which the by-pass pipe is closed while permitting exhaust gas in the by-pass pipe to move the flap valve against the resilient bias to allow exhaust gas to flow through the by-pass pipe when the exhaust gas in the by-pass pipe reaches a desired pressure;

wherein the resilient member is a coil spring helically wound about the shaft.

6. A muffler for an internal combustion engine, comprising:

a) a housing having a plurality of separate chambers, each of said chambers being separated from said other chambers by a partitioning wall;

b) an inlet pipe communicating with a first of the chambers for introducing exhaust gas to the first chamber;

c) an outlet pipe communicating with a second of the chambers for exhausting gas from the muffler;

d) a port in the partitioning wall separating the first and second chambers to provide an exhaust gas path extending from the first to the second chamber to permit exhaust gas to flow from the inlet pipe to the outlet pipe;

e) at least one second port in the partitioning wall separating the first and a third chamber to permit exhaust gas to flow between the first and third chambers;

f) a by-pass pipe providing an exhaust gas path extending from the third to the second chamber to permit exhaust gas to flow from the third chamber to the outlet pipe;

g) a flap valve, provided at the open downstream end of the by-pass pipe and supported on a shaft displaced laterally of and proximate the open downstream end, the flap valve being movable between a position at which the flap valve closes the by-pass pipe and a position at which the flap valve allows exhaust gas to flow through the by-pass pipe; and h) a resilient member positioned and supported proximate the flap valve to resiliently bias the flap valve to the position at which the by-pass pipe is closed while permitting exhaust gas in the by-pass pipe to move the flap valve against the resilient bias to allow exhaust gas to flow through the by-pass pipe when the exhaust gas in the by-pass pipe reaches a desired pressure;

wherein a buffer material is interposed between the flap valve and a stay supporting the shaft and the resilient member is disposed entirely within the second chamber proximate the open downstream end.

7. A muffler according to claim 6, wherein the flap valve has a convex portion proximate its central portion.

8. A muffler according to claim 6, wherein the flap valve and the open downstream end for receiving the flap valve are frusto-conical.

9. A muffler according to claim 6, wherein the flap valve engages the open downstream end of the by-pass pipe and a shock absorbing material is interposed between the flap valve and the open downstream end of the by-pass pipe.

10. A muffler for an internal combustion engine, comprising:

a) a housing having a plurality of separate chambers, each of said chambers being separated from said other chambers by a partitioning wall;

b) an inlet pipe communicating with a first of the chambers for introducing exhaust gas to the first chamber;

c) an outlet pipe communicating with a second of chambers for exhausting gas from the muffler;

d) a port in the partitioning wall separating the first and second chambers to provide an exhaust gas path extending from the first to the second chamber to permit exhaust gas to flow from the inlet pipe to the outlet pipe;

e) at least one second port in the partitioning wall separating the first and a third chamber to permit exhaust gas to flow between the first and third chambers;

f) a by-pass pipe providing an exhaust gas path extending from the third to the second chamber to permit exhaust gas to flow from the third chamber to the outlet pipe;

g) a flap valve, provided at the open downstream end of the by-pass pipe and supported on a shaft displaced laterally of and proximate the open downstream end, the flap valve being movable between a position at which the flap valve closes the by-pass pipe and a position at which the flap valve allows exhaust gas to flow through the by-pass pipe; and h) a resilient member positioned and supported proximate the flap valve to resiliently bias the flap valve to the position at which the by-pass pipe is closed while permitting exhaust gas in the by-pass pipe to move the flap valve against the resilient bias to allow exhaust gas to flow through the by-pass pipe when the exhaust gas in the by-pass pipe reaches a desired pressure;

wherein the resilient member is disposed entirely within the housing proximate the by-pass pipe and the resilient member is a coil spring helically wound about the shaft.

11. A muffler for an internal combustion engine, comprising:

a) a housing having a plurality of separate chambers, each of said chambers being separated from said other chambers by a partitioning wall;

b) an inlet pipe communicating with a first of the chambers for introducing exhaust gas to the first chamber;

c) an outlet pipe communicating with a second of the chambers for exhausting gas from the muffler;

d) a port in the partitioning wall separating the first and second chambers to provide an exhaust gas path extending from the first to the second chamber to permit exhaust gas to flow from the inlet pipe to the outlet pipe;

e) at least one second port in the partitioning wall separating the first and a third chamber to permit exhaust gas to flow between the first and third chambers;

f) a by-pass pipe providing an exhaust gas path extending from the third to the second chamber to permit exhaust gas to flow from the third chamber to the outlet pipe;

g) a flap valve, provided at an open downstream end of the by-pass pipe, and supported on a shaft displaced laterally of and proximate said open downstream end, the flap valve being movable between a position at which the valve closes the by-pass pipe and a position at which the valve allows exhaust gas to flow through the by-pass pipe; and h) a resilient member positioned and supported proximate the flap valve to resiliently bias the flap valve to the position at which the by-pass pipe is closed while permitting exhaust gas in the by-pass pipe to move the valve against the resilient bias to allow exhaust gas to flow through the by-pass pipe when the exhaust gas in the by-pass pipe reaches a desired pressure;

wherein the resilient member is composed of Inconel and a buffer material is interposed between the flap valve and a stay supporting the shaft.

12. A muffler according to claim 11, wherein the flap valve has a convex portion proximate its central portion.

13. A muffler according to claim 11, wherein the flap valve and the open downstream end of the by-pass pipe for receiving the flap valve are frusto-conical.

14. A muffler according to claim 11, wherein the flap valve engages an open end of the by-pass pipe and a shock absorbing material is interposed between the flap valve and the open end of the by-pass pipe.

15. A muffler for an internal combustion engine, comprising:

a) a housing having a plurality of separate chambers, each of said chambers being separated from said other chambers by a partitioning wall;

b) an inlet pipe communicating with a first of the chambers for introducing exhaust gas to the first chamber;

c) an outlet pipe communicating with a second of chambers for exhausting gas from the muffler;

d) a port in the partitioning wall separating the first and second chambers to provide an exhaust gas path extending from the first to the second chamber to permit exhaust gas to flow from the inlet pipe to the outlet pipe;

e) at least one second port extending through the partitioning wall separating the first and third chambers to provide an additional exhaust gas path extending from the first to the third chamber to permit exhaust gas to flow from the inlet pipe to the outlet pipe;

f) a by-pass pipe providing an exhaust gas path extending from the third to the second chamber to permit exhaust gas to flow from the third chamber to the outlet pipe;

g) a flap valve, provided at the open downstream end of the by-pass pipe and supported on a shaft displaced laterally of an proximate the open downstream end, the flap valve being movable between a position at which the flap valve closes the by-pass pipe and a position at which the flap valve allows exhaust gas to flow through the by-pass port; and h) a resilient member positioned and supported proximate the flap valve to resiliently bias the flap valve to the position at which the by-pass pipe is closed while permitting exhaust gas in the by-pass pipe to move the flap valve against the resilient bias to allow exhaust gas to flow through the by-pass pipe when the exhaust gas in the by-pass pipe reaches a desired pressure;

wherein the resilient member is composed of Inconel and is a coil spring helically wound about the shaft.

* * * * *